US011758338B2

(12) United States Patent
Solum et al.

(10) Patent No.: US 11,758,338 B2
(45) Date of Patent: Sep. 12, 2023

(54) AUTHENTICATION AND ENCRYPTION KEY EXCHANGE FOR ASSISTIVE LISTENING DEVICES

(71) Applicant: Starkey Laboratories, Inc., Eden Prairie, MN (US)

(72) Inventors: Jeffrey Paul Solum, Greenwood, MN (US); Gregory John Haubrich, Champlin, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1 day.

(21) Appl. No.: 17/303,695

(22) Filed: Jun. 4, 2021

(65) Prior Publication Data

US 2021/0385589 A1 Dec. 9, 2021

Related U.S. Application Data

(60) Provisional application No. 63/035,269, filed on Jun. 5, 2020.

(51) Int. Cl.
*H04R 25/00* (2006.01)

(52) U.S. Cl.
CPC ..... *H04R 25/55* (2013.01)

(58) Field of Classification Search
CPC ..... H04R 25/55; H04R 25/554; H04R 25/552
See application file for complete search history.

(56) References Cited

U.S. PATENT DOCUMENTS

| | | | | |
|---|---|---|---|---|
| 5,565,759 | A | 10/1996 | Dunstan | |
| 2013/0343585 | A1 | 12/2013 | Bennett et al. | |
| 2014/0173686 | A1* | 6/2014 | Kgil | H04L 63/205 726/1 |
| 2018/0124526 | A1* | 5/2018 | Solum | H04L 63/06 |

* cited by examiner

*Primary Examiner* — Sunita Joshi
(74) *Attorney, Agent, or Firm* — Schwegman Lundberg & Woessner, P.A.

(57) ABSTRACT

Disclosed herein, among other things, are systems and methods for authentication and encryption key exchange with an ALD for hearing device applications. A method includes receiving an acoustic input at a microphone of a hearing device, and receiving a wireless signal over a wireless link from an assistive listening device (ALD) at an antenna of the hearing device, the wireless signal including digital audio information. The acoustic input is compared to the digital audio information using a processor of the hearing device. Upon determining that the acoustic input and the digital audio information are correlated at a threshold level, the processor is used to create and distribute an encryption key to the ALD to secure the wireless link. The ALD may include a processor for correlating the input and the information, and for creating and distributing the encryption key, in some embodiments.

20 Claims, 4 Drawing Sheets

AUTHENTICATION AND ENCRYPTION KEY EXCHANGE FOR ASSISTIVE LISTENING DEVICES

CROSS-REFERENCE TO RELATED APPLICATION

This patent application claims the benefit of U.S. Provisional Patent Application No. 63/035,269, filed Jun. 5, 2020, which is incorporated by reference herein in its entirety.

TECHNICAL FIELD

This document relates generally to wireless communication for hearing device systems and more particularly to authentication and encryption key exchange for assistive listening devices (ALDs).

BACKGROUND

Examples of hearing devices, also referred to herein as hearing assistance devices or hearing instruments, include both prescriptive devices and non-prescriptive devices. Specific examples of hearing devices include, but are not limited to, hearing aids, headphones, ALDs, and earbuds.

Hearing aids are used to assist individuals suffering hearing loss by transmitting amplified sounds to ear canals. In one example, a hearing aid is worn in and/or around a wearer's ear. Hearing aids may include processors and electronics that improve the listening experience for a specific wearer or in a specific acoustic environment.

In some hearing environments, background noise or other acoustic problems may limit the effectiveness of a hearing aid. In these situations, ALDs can be used to transmit audio information to the wearer using a wireless communication signal. Many typical ALDs use near-field inductive communication of the audio information to and from a telecoil in the hearing aid. The telecoil has a short connectivity range, providing inherent security for the transmitted and received audio information. However, ALDs incorporating other types of transmitters and receivers, such as Bluetooth™ transceivers, may pose security risks due to their longer range of communication.

Thus, a system and method for securing communication in ALD systems is needed.

SUMMARY

Disclosed herein, among other things, are systems and methods for authentication and encryption key exchange with an assistive listening device (ALD) for hearing device applications. A method includes receiving an acoustic input at a microphone of a hearing device, and receiving a wireless signal over a wireless link from an ALD at an antenna of the hearing device, the wireless signal including digital audio information. The acoustic input is compared to the digital audio information using a processor of the hearing device. Upon determining that the acoustic input and the digital audio information are correlated at a threshold level, the processor is used to create and distribute an encryption key to the ALD to secure the wireless link.

Various aspects of the present subject matter include a method for authentication and encryption key exchange with a hearing device for ALD applications. The method includes receiving an acoustic input at a microphone of an ALD, and receiving a wireless signal over a wireless link from a hearing device at an antenna of the ALD, the wireless signal including digital audio information. The acoustic input is compared to the digital audio information using a processor of the ALD. Upon determining that the acoustic input and the digital audio information are correlated at a threshold level, the processor is used to create and distribute an encryption key to the hearing device to secure the wireless link.

Various aspects of the present subject matter include a system including a hearing device configured to be worn in an ear of a wearer, the hearing device including a microphone, first wireless communication electronics, memory and a processor. The system further includes an ALD configured to communicate with the hearing device, the ALD including second wireless communication electronics. The memory is programmed with instructions that when executed by the processor, cause the processor to compare an acoustic input received at the microphone to digital audio information from a wireless signal received from the ALD over a wireless link, and upon determining that the acoustic input and the digital audio information are correlated at a threshold level, create and distribute an encryption key to the ALD to secure the wireless link.

Various aspects of the present subject matter include a system including a hearing device configured to be worn in an ear of a wearer, the hearing device including first wireless communication electronics. The system also includes an ALD configured to communicate with the hearing device, the ALD including a microphone, second wireless communication electronics, memory and a processor. The memory is programmed with instructions that when executed by the processor, cause the processor to compare an acoustic input received at the microphone to digital audio information from a wireless signal received from the hearing device over a wireless link, and upon determining that the acoustic input and the digital audio information are correlated at a threshold level, create and distribute an encryption key to the hearing device to secure the wireless link.

This Summary is an overview of some of the teachings of the present application and not intended to be an exclusive or exhaustive treatment of the present subject matter. Further details about the present subject matter are found in the detailed description and appended claims.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1:
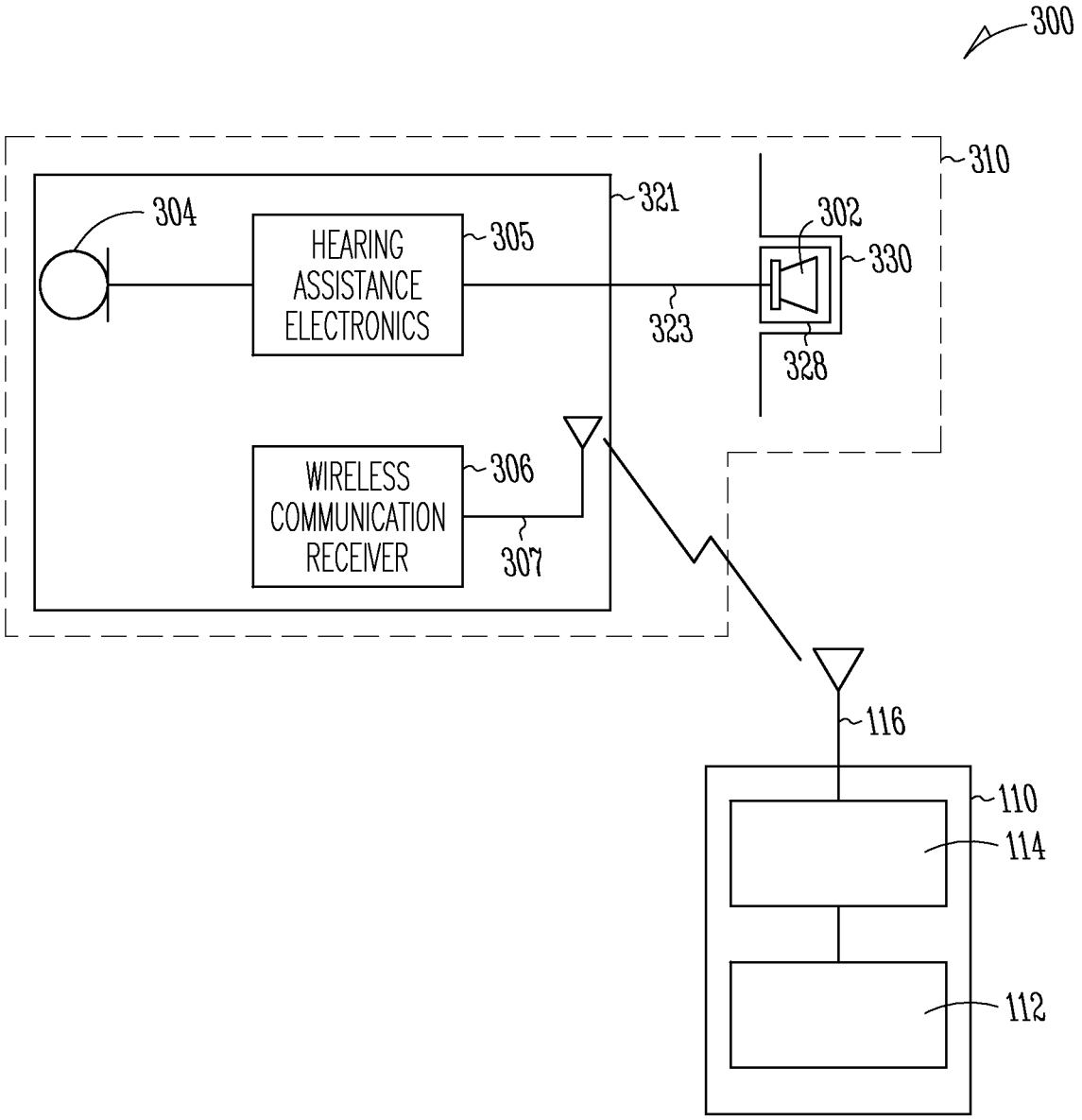
FIG. 1 illustrates a block diagram of a system for authentication and encryption key exchange with an ALD for hearing device applications, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing devices generally, including earbuds, headsets, headphones and hearing assistance devices using the example of hearing aids. Other hearing devices include, but are not limited to, those in this document. It is understood that their use in the description is intended to demonstrate the present subject matter, but not in a limited or exclusive or exhaustive sense.

Assistive listening devices (ALDs) can be used to transmit audio information to a hearing device using a wireless communication signal in situations where background noise or other acoustic problems may limit the effectiveness of the hearing device. Many typical ALDs use near-field inductive communication of the audio information to and from a telecoil in the hearing device. The telecoil has a short connectivity range, providing inherent security for the transmitted and received audio information. At some point, telecoils in hearing devices may be replaced by other types of wireless communication electronics for communications with ALDs. For example, Bluetooth™ transceivers could be used for communication between hearing devices and ALDs. However, Bluetooth™ wireless communication can be two-way with much longer range than inductive communications, so the chances of eavesdropping are significantly increased. To prevent such eavesdropping both intentional and unintentional, it may be desirable in some cases to ensure that the communication is secured using encryption methods which can prevent such unwanted eavesdropping.

Hearing aid wearers who communicate with bank tellers, medical providers, pharmacists, hotel receptionists and the like using ALDs may want to ensure that their communication is private. To that end, there is a need in the art for a way to ensure privacy similar to what a person with normal hearing has when in a normal conversation with these service providers.

The present subject matter provides systems and methods for authentication and encryption key exchange with an ALD for hearing device applications. In some embodiments, a method of authenticating that a hearing device wearer is within acoustic range (or "earshot") of the service provider is provided such that encryption keys can be exchanged between the hearing device and the ALD of the service provider for temporarily or semi-permanently securing a wireless communication link between the hearing device wearer and the ALD of the service provider.

In various embodiments, the hearing device is equipped with a microphone which can be used to receive acoustic inputs from a nearby ALD device to determine that the ALD device is within acoustic range of the wearer by correlating the acoustic input with audio information received from the ALD via a wireless link. In some embodiments, the ALD base unit may be equipped with either a speaker or a microphone or both for the purpose of sending or receiving acoustic signals to be used in the authentication procedure of the present subject matter. In various embodiments, both the hearing instrument and the ALD base unit are equipped with Bluetooth™ transceivers capable of sending and receiving encrypted data and audio information.

Several methods are described herein that enable the devices (a hearing device worn by a wearer and an ALD device) to authenticate and secure the wireless communication (by, for example, exchanging encryption keys) between the devices for transporting digital audio information. In various embodiments, an acoustic signal received by the hearing device microphone is correlated with a wireless signal received by a wireless receiver of the hearing device, such as a Bluetooth™ Low Energy (BLE) communication receiver. If the audio stream from the wireless signal and the acoustic stream from the acoustic signal are correlated using a programmable threshold, a user can be assured that the audio signal contains audio information from the acoustic source, and is not from an unrelated transmitter.

In various embodiments, an acoustic or ultrasonic modem can be included at the ALD base unit such that the unit may send acoustic tones or sounds to the hearing device that can be interpreted as digital information for the purpose of authenticating a wearer within earshot of the ALD base unit. Further, such a signal may be used to convey link keys to the wearer/recipient's acoustic modem within the hearing device using the microphone contained therein. Examples of such signaling include, but not limited to: dual tone multi-frequency (DTMF) signaling, frequency-shift keying (FSK) signaling, or spread spectrum signaling. Such acoustic information may be used to convey authenticity of a hearing device wearer within earshot of the ALD base unit and/or may be used to convey link keys for the purpose of encrypting the wireless link which conveys digital audio information between the hearing device and the ALD base unit.

In one embodiment, the wearer's own voice could be used as an authenticating signal. For example, the wearer may begin speaking to the attendant or bank teller (or other individual providing input to the ALD system). The wearer's voice may be picked up by the wearer's own hearing device microphone and sent over an unencrypted wireless link to an ALD unit of the ALD system. The ALD unit, over which the attendant or bank teller communicates with the wearer and which may be equipped with a microphone (built into a desk of the bank teller, for example), can be used to sense the wearer's voice which is correlated with the wireless audio being received from the hearing device. If a sufficient match is achieved, the hearing device and the ALD unit may enter pairing mode and create a secure connection by, for example, exchanging keys which may be used for encrypting the audio sent between the hearing device and the ALD unit. In one embodiment, a key word or key phrase known to the speaker may be used for the correlation.

In still another variant, the attendant or bank teller's voice may be used to correlate and authenticate the audio transmission in some embodiments, a random sound signal emanating from the ALD base unit may be used, which is correlated with a wireless version of the same sound sent to the hearing device. The hearing device would then receive both signals and verify the correlation using a programmable threshold to trigger the hearing device and ALD base unit to enter a pairing mode. Once in pairing mode, the wireless connection may be secured using encryption keys established during the pairing process to encrypt the wireless audio, in various embodiments. Other types of security for the wireless connection can be used without departing from the scope of the present subject matter.

The methods described herein can be used to ensure that both parties (the hearing device wearer and the source of the ALD audio, such as a service provider) are within earshot of one another, and to subsequently secure the ALD audio and prevent long range eavesdropping of wireless signals. Significantly, the methods described herein provide for automatically authenticating the wearer's proximity to the service provider and securing ALD communication without user intervention, so that the user does not need to enter text into a keyboard as is used in other authentication procedures.

FIG. 1 illustrates a block diagram of a system 300, according to the present subject matter. The system 300 shows an external device 110 in wireless communication with a hearing device 310. In various embodiments, the hearing device 310 includes a first housing 321, an acoustic receiver or speaker 302 in a second housing 328 positioned in or about the ear canal 330 of a wearer and conductors 323 coupling the speaker 302 to the first housing 321 and the electronics enclosed therein. The electronics enclosed in the first housing 321 include a microphone 304, hearing assistance electronics 305, a wireless communication receiver 306 and an antenna 307, in an embodiment. In various embodiments, the hearing assistance electronics 305 includes at least one processor and memory components. The memory components store program instructions for the at least one processor. The program instructions include functions allowing the processor and other components to process audio received by the microphone 304 and transmit processed audio signals to the speaker 302. The speaker 302 emits the processed audio signal as sound in the user's ear canal. In various embodiments, the hearing assistance electronics includes functionality to amplify, filter, limit, condition or a combination thereof, the sounds received using the microphone 304.

In the illustrated embodiment of FIG. 1, the wireless communication receiver 306 is connected to the hearing assistance electronics 305 and the conductors 323 connect the hearing assistance electronics 305 and the speaker 302. In various embodiments, the external device 110 includes a streaming audio device such as an ALD. The external device 110 includes an antenna 116 connected to a radio circuit 114 that include a transmitter, in an embodiment. In various embodiments, the external device 110 includes one or more processors 112 or processing components. The external device 110 may also include one or more microphones and/or one or more speakers, in various embodiments.

Figure 2:
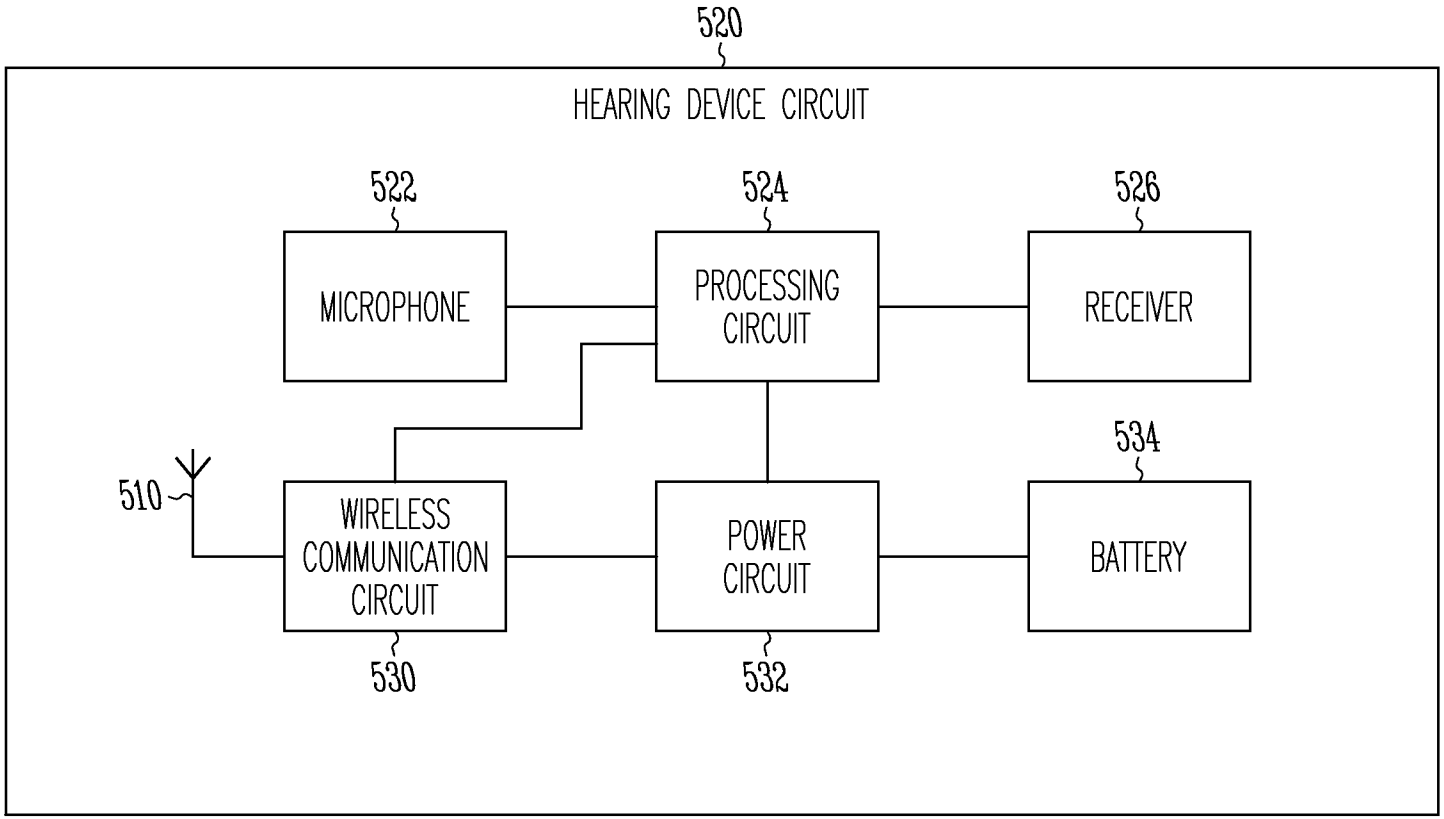
FIG. 2 illustrates a block diagram of a hearing device circuit, according to various embodiments of the present subject matter.

FIG. 2 illustrates a block diagram of a hearing device circuit, according to various embodiments of the present subject matter. Hearing device circuit 520 represents an example of portions of a hearing device 310 and includes a microphone 522, a wireless communication circuit 530, an antenna 510, a processing circuit 524, a receiver (speaker) 526, a battery 534, and a power circuit 532. Microphone 522 receives sounds from the environment of the hearing device wearer (wearer of hearing device 310). Wireless communication circuit 530 communicates with another device wirelessly using antenna 510, including receiving programming codes, streamed audio signals, and/or other audio signals and transmitting programming codes, audio signals, and/or other signals. Examples of the other device includes the other hearing device of a pair of hearing devices for the same wearer, a hearing device host device, an ALD, an audio streaming device, a telephone, and other devices capable of communicating with hearing devices wirelessly. Processing circuit 524 controls the operation of hearing device 310 using the programming codes and processes the sounds received by microphone 522 and/or the audio signals received by wireless communication circuit 530 to produce output sounds. Receiver 526 transmits output sounds to an ear canal of the hearing device wearer. Battery 534 and power circuit 532 constitute the power source for the operation of hearing device circuit 520. In various embodiments, power circuit 532 can include a power management circuit. In various embodiments, battery 534 can include a rechargeable battery, and power circuit 532 can include a recharging circuit for recharging the rechargeable battery.

Figure 3:
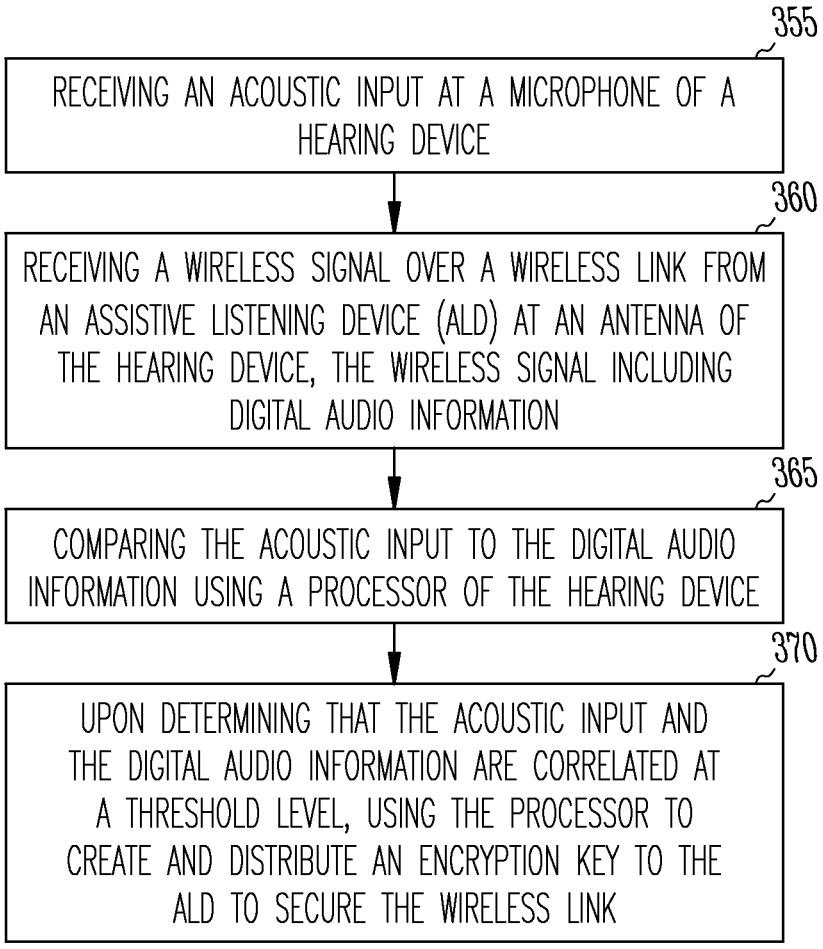
FIG. 3 illustrates a flow diagram of a method for authentication and encryption key exchange with an ALD for hearing device applications, according to various embodiments of the present subject matter.

FIG. 3 illustrates a flow diagram of a method for authentication and encryption key exchange with an ALD for hearing device applications, according to various embodiments of the present subject matter. The method includes receiving an acoustic input at a microphone of a hearing device, at step 355, and receiving a wireless signal over a wireless link from an assistive listening device (ALD) at an antenna of the hearing device, at step 360, the wireless signal including digital audio information. At step 365, the acoustic input is compared to the digital audio information using a processor of the hearing device. Upon determining that the acoustic input and the digital audio information are correlated at a threshold level, the processor is used to create and distribute an encryption key to the ALD to secure the wireless link, at step 370.

According to various embodiments, the wireless link includes a Bluetooth™ wireless link or a Bluetooth™ Low Energy (BLE) link. Other types of wireless communication protocols or connections can be used for the wireless link without departing from the scope of the present subject matter. The threshold level for correlation is programmable, in various embodiments. In various embodiments, the acoustic input is generated by the ALD using one or more of dual tone multi-frequency (DTMF) signaling, frequency-shift keying (FSK) signaling, or spread spectrum signaling.

Figure 4:
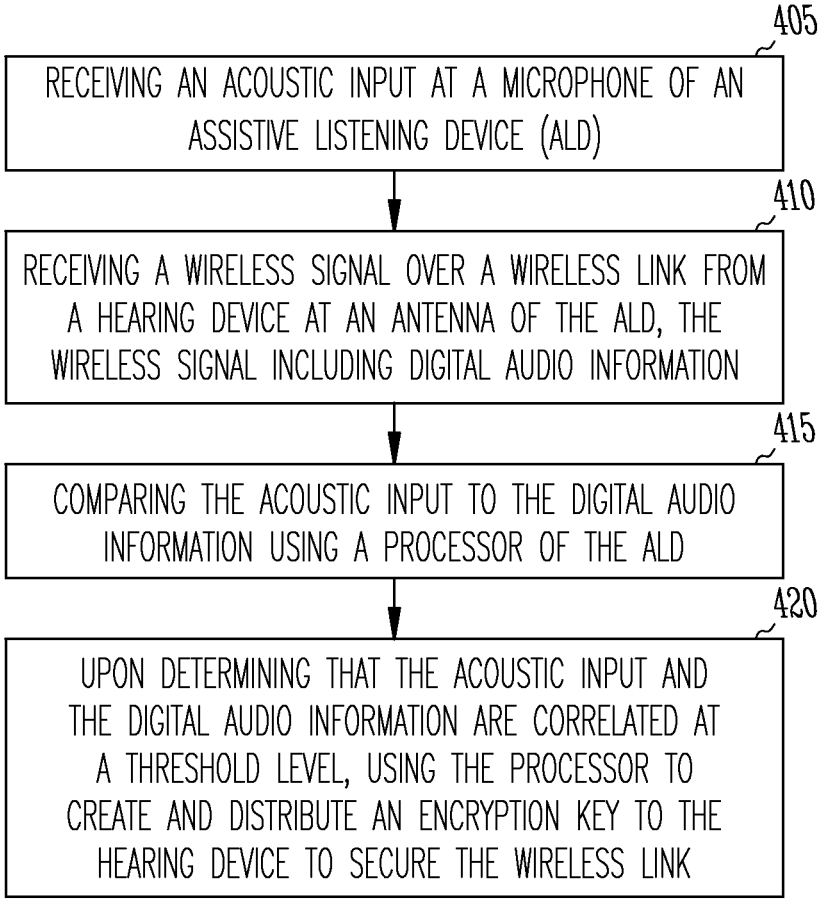
FIG. 4 illustrates a flow diagram of a method for authentication and encryption key exchange with a hearing device for ALD applications, according to various embodiments of the present subject matter.

FIG. 4 illustrates a flow diagram of a method for authentication and encryption key exchange with a hearing device for ALD applications, according to various embodiments of the present subject matter. The method includes receiving an acoustic input at a microphone of an assistive listening device (ALD), at step 405, and receiving a wireless signal over a wireless link from a hearing device at an antenna of the ALD, at step 410, the wireless signal including digital audio information. At step 415, the acoustic input is compared to the digital audio information using a processor of the ALD. Upon determining that the acoustic input and the digital audio information are correlated at a threshold level, the processor is used to create and distribute an encryption key to the hearing device to secure the wireless link, at step 420. The acoustic input includes a voice of a wearer of the hearing device, in an embodiment. In various embodiments, the ALD includes an acoustic or ultrasonic modem configured to send signals to the hearing device to distribute the encryption key.

Various embodiments of the present subject matter include a system including a hearing device configured to be worn in an ear of a wearer, the hearing device including a microphone, first wireless communication electronics, memory and a processor. The system further includes an assistive listening device (ALD) configured to communicate with the hearing device, the ALD including second wireless communication electronics. The memory is programmed with instructions that when executed by the processor, cause the processor to compare an acoustic input received at the microphone to digital audio information from a wireless signal received from the ALD over a wireless link, and upon determining that the acoustic input and the digital audio information are correlated at a threshold level, create and distribute an encryption key to the ALD to secure the wireless link.

In various embodiments, the hearing device is a personal sound amplification product (PSAP). The hearing device includes an ear bud, in various embodiments. In some embodiments, the hearing device is a hearing aid, such as an in-the-ear (ITE) hearing aid, a behind-the-ear (BTE) hearing aid, in-the-canal (ITC) hearing aid, a receiver-in-canal (RIC) hearing aid, or a completely-in-the-canal (CIC) hearing aid. Other types of hearing devices can be used without departing from the scope of the present subject matter.

Various embodiments of the present subject matter include a system including a hearing device configured to be worn in an ear of a wearer, the hearing device including first wireless communication electronics. The system also includes an assistive listening device (ALD) configured to communicate with the hearing device, the ALD including a microphone, second wireless communication electronics, memory and a processor. The memory is programmed with instructions that when executed by the processor, cause the processor to compare an acoustic input received at the microphone to digital audio information from a wireless signal received from the hearing device over a wireless link, and upon determining that the acoustic input and the digital audio information are correlated at a threshold level, create and distribute an encryption key to the hearing device to secure the wireless link.

The present subject matter provides several benefits. For example, the present subject matter provides for authentication and encryption key exchange with an assistive listening device (ALD) for hearing device applications. The present subject matter leverages existing processing and acoustic reception capabilities of hearing devices and/or ALDs to provide for secure communication between the hearing devices and ALDs. Significantly, the authentication and security provided by the present subject matter are automated, and thus do not require action or intervention by the wearer of the hearing device or any other user of the ALD system.

Various embodiments of the present subject matter support wireless communications with a hearing device. In various embodiments the wireless communications may include standard or nonstandard communications. Some examples of standard wireless communications include link protocols including, but not limited to, Bluetooth™, Bluetooth™ Low Energy (BLE), IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications while others support NFMI. Although the present system is demonstrated as a radio system, it is possible that other forms of wireless communications may be used such as ultrasonic, optical, infrared, and others. It is understood that the standards which may be used include past and present standards. It is also contemplated that future versions of these standards and new future standards may be employed without departing from the scope of the present subject matter.

Bluetooth™ Low Energy (BLE) connections are made between a master device and one or more slave devices. This topology is referred to as a piconet. Radio controllers and in particular the radio controller in the master device is responsible for the scheduling of events, and those events are scheduled with one or more slave devices. In addition, the radio controller mitigates other competing radio connections such as WiFi connections and even cellular connections if the controller is part of a smart phone or media device.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

Hearing assistance devices typically include at least one enclosure or housing, a microphone, hearing assistance device electronics including processing electronics, and a speaker or "receiver." Hearing assistance devices may include a power source, such as a battery. In various embodiments, the battery is rechargeable. In various embodiments multiple energy sources are employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing assistance devices include a processor. In digital hearing assistance devices with a processor, programmable gains may be employed to adjust the hearing assistance device output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application may be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments of the present subject matter the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments of the present subject matter, different realizations of the block diagrams, circuits, and processes set forth herein may be created by one of skill in the art without departing from the scope of the present subject matter.

It is further understood that different hearing devices may embody the present subject matter without departing from the scope of the present disclosure. The devices depicted in the figures are intended to demonstrate the subject matter, but not necessarily in a limited, exhaustive, or exclusive sense. It is also understood that the present subject matter may be used with a device designed for use in the right ear or the left ear or both ears of the wearer.

The present subject matter is demonstrated for hearing devices, including hearing assistance devices, including but not limited to, behind-the-ear (BTE), in-the-ear (ITE), in-the-canal (ITC), receiver-in-canal (RIC), invisible-in-canal (IIC) or completely-in-the-canal (CIC) type hearing assistance devices. It is understood that behind-the-ear type hearing assistance devices may include devices that reside substantially behind the ear or over the ear. Such devices may include hearing assistance devices with receivers associated with the electronics portion of the behind-the-ear device, or hearing assistance devices of the type having receivers in the ear canal of the user, including but not limited to receiver-in-canal (RIC) or receiver-in-the-ear (RITE) designs. The present subject matter may also be used in hearing assistance devices generally, such as cochlear implant type hearing devices. The present subject matter may also be used in deep insertion devices having a transducer, such as a receiver or microphone. The present subject matter may be used in devices whether such devices are standard or custom fit and whether they provide an open or an occlusive design. It is understood that other hearing devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method, comprising:

receiving an acoustic input at a microphone of a hearing device;

receiving a wireless signal over a wireless link from an assistive listening device (ALD) at an antenna of the hearing device, the wireless signal including digital audio information;

comparing the acoustic input to the digital audio information using a processor of the hearing device; and upon determining that the acoustic input and the digital audio information are correlated at a threshold level, using the processor to authenticate the ALD allowing the processor or the ALD to distribute an encryption key over the wireless link to secure the wireless link.

2. The method of claim 1, wherein the wireless link includes a BluetoothTM wireless link.

3. The method of claim 1, wherein the wireless link includes a BluetoothTM Low Energy (BLE) link.

4. The method of claim 1, wherein the threshold level is programmable.

5. The method of claim 1, wherein the acoustic input is generated by the ALD using one or more of dual tone multi-frequency (DTMF) signaling, frequency-shift keying (FSK) signaling, or spread spectrum signaling.

6. A method, comprising:

receiving an acoustic input at a microphone of an assistive listening device (ALD);

receiving a wireless signal over a wireless link from a hearing device at an antenna of the ALD, the wireless signal including digital audio information;

comparing the acoustic input to the digital audio information using a processor of the ALD; and upon determining that the acoustic input and the digital audio information are correlated at a threshold level, using the processor to authenticate the hearing device allowing the processor or the hearing device to distribute an encryption key over the wireless link to secure the wireless link.

7. The method of claim 6, wherein the acoustic input includes a voice of a wearer of the hearing device.

8. The method of claim 6, wherein the ALD includes an acoustic or ultrasonic modem configured to send signals to the hearing device to distribute the encryption key.

9. A system, comprising:

a hearing device configured to be worn in an ear of a wearer, the hearing device including a microphone, first wireless communication electronics, memory and a processor;

an assistive listening device (ALD) configured to communicate with the hearing device, the ALD including second wireless communication electronics; and wherein the memory is programmed with instructions that when executed by the processor, cause the processor to:

compare an acoustic input received at the microphone to digital audio information from a wireless signal received from the ALD over a wireless link; and upon determining that the acoustic input and the digital audio information are correlated at a threshold level, authenticate the ALD allowing the processor or the ALD to distribute an encryption key over the wireless link to secure the wireless link.

10. The system of claim 9, wherein the hearing device is a personal sound amplification product (PSAP).

11. The system of claim 9, wherein the hearing device is a hearing aid.

12. The system of claim 11, wherein the hearing aid includes an in-the-ear (ITE) hearing aid.

13. The system of claim 11, wherein the hearing aid includes a behind-the-ear (BTE) hearing aid.

14. The system of claim 11, wherein the hearing aid includes an in-the-canal (ITC) hearing aid.

15. The system of claim 11, wherein the hearing aid includes a receiver-in-canal (RIC) hearing aid.

16. The system of claim 11, wherein the hearing aid includes a completely-in-the-canal (CIC) hearing aid.

17. A system, comprising:

a hearing device configured to be worn in an ear of a wearer, the hearing device including first wireless communication electronics;

an assistive listening device (ALD) configured to communicate with the hearing device, the ALD including a microphone, second wireless communication electronics, memory and a processor; and wherein the memory is programmed with instructions that Then executed by the processor, cause the processor to:

compare an acoustic input received at the microphone to digital audio information from a wireless signal received from the hearing device over a wireless link; and upon determining that the acoustic input and the digital audio infoimation are correlated at a threshold level, authenticate the hearing device allowing the processor or the hearing device to distribute an encryption key over the wireless link to secure the wireless link.

18. The system of claim 17, wherein the wireless link includes a Bluetooth™ wireless link.

19. The system of claim 17, wherein the wireless link includes a Bluetooth™ Low Energy (BLE) link.

20. Thesystem of claim 17, wherein the threshold level is programmable.

* * * * *